US006010077A

United States Patent [19]

Casey

[11] Patent Number: 6,010,077

[45] Date of Patent: Jan. 4, 2000

[54] NOZZLE FOR DELIVERING LIQUID/GAS MIXTURE

[76] Inventor: Alan Patrick Casey, 7 Technology Drive, Arundel, Queensland 4214, Australia

[21] Appl. No.: 08/973,792

[22] PCT Filed: Jun. 6, 1996

[86] PCT No.: PCT/AU96/00346

§ 371 Date: Dec. 9, 1997

§ 102(e) Date: Dec. 9, 1997

[87] PCT Pub. No.: WO96/41685

PCT Pub. Date: Dec. 27, 1996

[51] Int. Cl.[7] ..... B05B 7/06

[52] U.S. Cl. ..... 239/8; 239/419.5; 239/427

[58] Field of Search ..... 239/418, 419, 239/419.5, 427, 427.3, 589, 590, 590.5, 1, 5, 8

[56] References Cited

U.S. PATENT DOCUMENTS

| | | |
|---|---|---|
| 1,697,334 | 1/1929 | Vitte . |
| 2,583,726 | 1/1952 | Chalom . |
| 3,782,639 | 1/1974 | Boltz et al. . |
| 4,559,275 | 12/1985 | Matt et al. . |
| 4,756,478 | 7/1988 | Endo et al. . |
| 5,294,056 | 3/1994 | Buchholz et al. . |

FOREIGN PATENT DOCUMENTS

| | | |
|---|---|---|
| 7-12030 | 1/1995 | Japan . |
| 2 174 760 | 11/1986 | United Kingdom . |
| WO 94/08724 | 4/1994 | WIPO . |
| WO 95/04881 | 2/1995 | WIPO . |

*Primary Examiner*—Andres Kashnikow
*Assistant Examiner*—Sean P. O'Hanlon
*Attorney, Agent, or Firm*—Alston & Bird LLP

[57] ABSTRACT

A nozzle arrangement comprising a plurality of nozzle assemblies arranged in an axially aligned and spaced apart arrangement, with a gas and/or liquid inspiration zone between the nozzle assemblies. Each nozzle assembly has a flow passage with an expansion zone formed proximate the outlet end thereof, and at least one discontinuity in the expansion zone formed as an annular shoulder followed by a cylindrical portion, which serves to minimize the build up of a liquid film on the inside surface of the flow passage.

12 Claims, 8 Drawing Sheets

NOZZLE FOR DELIVERING LIQUID/GAS MIXTURE

TECHNICAL FIELD

The present invention relates to a nozzle for delivering a liquid/gas mixture to, for example, the intake manifold or combustion chamber of an internal combustion engine. The nozzle may form part of a fuel injector for an engine, particularly but not exclusively where the injector produces a mixture where a fine mist of fuel droplets are entrained in an airstream prior to being input to a combustion chamber.

Even though the present invention will be described in relation to a preferred application in fuel injectors for internal combustion engines it will be appreciated that it has applicability to any environment where a liquid droplet/gas mixture is to be delivered such that liquid film adherence at a nozzle outlet is to be ameliorated either in continuous or discontinuous delivery systems.

BACKGROUND ART

It is known to create a liquid/gas mixture by delivering a generally cohesive sheet of liquid into a stream of gas flowing through a passage, with the gas acting to shear liquid droplets away from the sheet of liquid. Such a liquid/gas mixture has been found to have a significantly smaller average liquid droplet size than that produced by delivering liquid under pressure through a restricted nozzle to form a spray as many commonly available motor vehicle injectors operate. A liquid/gas mixing apparatus which operates by shearing liquid droplets away from a sheet of liquid is disclosed in U.S. Pat. No. 5,735,468 and which is incorporated herein by reference.

Due to the very small size of the liquid droplets, the liquid/gas mixture produced by shearing liquid droplets from a sheet of liquid using a stream of gas can be delivered along a passage beyond the point at which the liquid is sheared from the sheet, and out through a nozzle.

If a nozzle has a simple continuous expansion zone leading to its outlet, it has been found that such a nozzle delivering liquid/gas mixtures tends to adhere liquid to and build up liquid on the inside surface of the expansion zone, and which liquid is pushed along the passage and out from the outlet as relatively large droplets as compared with the fine mist entrained in the stream of gas flowing into the nozzle.

It would be desirable to eliminate or at least minimize such adherence, build up and delivery of liquid droplets from the nozzle outlet.

The above and other objects and advantages of the present invention are achieved by the provision of a nozzle arrangement for delivering a liquid/gas mixture which comprises a plurality of nozzle assemblies. Each nozzle assembly has a body which includes a flow-through passage leading to an outlet, an expansion zone proximate the outlet, and at least one discontinuity in the expansion zone formed as a radially extending step-wise enlargement followed by a parallel-sided cylindrical portion extending toward the outlet. The discontinuity is adapted to reduce liquid film adherence at the outlet, and the nozzle assemblies are axially aligned and spaced apart by respective gas and/or liquid inspiration zones.

Preferably each discontinuity is substantially of circumferential extent.

The expansion zone preferably has a plurality of discontinuities.

Preferably, the flow passage also has a restriction or compression zone spaced upstream from the expansion zone. The restriction or compression zone is preferably a smoothly converging portion of the flow passage, and which leads to a throat portion which is intermediate the restriction zone and the expansion zone.

The flow passage is preferably generally circular in cross-section as is each expansion zone.

The or each step-wise enlargement in the expansion zone is/are preferably in the form of a circumferential edge having a first diameter, a radially outwardly extending surface which is generally normal to the central axis of the flow passage, and an axially extending cylindrical surface having a second diameter which is a predetermined amount larger than the first diameter, and which leads to the next adjacent step-wise enlargement or the outlet.

In one specific embodiment, the intermediate throat portion has a diameter of about 4 mm, the axial cylindrical surface of a first step-wise enlargements has a diameter of about 5 mm, and the axial cylindrical surface of second and third step-wise enlargements have diameters of about 6 mm and 7 mm respectively. The restriction zone preferably converges from a diameter of about 10 mm to the 4 mm diameter of the throat portion over an axial distance of about 5 mm. Further, the throat portion preferably extends about 13 mm, the cylindrical surfaces of first and second step-wise enlargements extend about 3 mm in the axial direction, and the cylindrical surface of a third step-wise enlargement extends about 4 mm in the axial direction.

The number of nozzle stages separated by inspiration zones can be varied as desired.

In use with embodiments in accord with the disclosure in U.S. Pat. No. 5,735,468 I have found that in the environment of internal combustion engines a minimum quantity of pressurised air is required to atomize a liquid fuel to a desired particle size. In one prototype this has been established at less than 1% stoichiometric air at 100 psi. That pressurised air is forced through an injector to shear droplets from the conical sheet of fuel with the resultant fuel/air mixture exiting via a delivery nozzle in accord with an embodiment of the present invention.

The addition of premix air which is a minimum quantity of air necessary (when combined with primary air which effects a shearing action of the fuel within the injector body) that facilitates a preparation of a high quality premix for good combustion. The quantity of premix air including atomizing air is normally approximately 5% of the total required for a stoichiometric mixture.

With the further addition of vaporization air (tertiary air) it is possible to vaporize the fuel and give further premix to enhance combustion. Vaporization air is understood to mean the minimum quantity of air necessary (when combined with primary and secondary air) to vaporize the fuel and give further premix to enhance combustion. Such tertiary air can be inspirated into the fuel/air mixture via the inspiration zone or via radially disposed air inlets on a shroud extending past the outlet of the nozzle assemblies. Of course, as stated above, the number of nozzle assemblies can be varied as desired.

I have found that a multiple nozzle arrangement in accord with the present invention not only ameliorates fuel film adherence but also creates good mixing and reduces the velocity of and broadens the fuel air mixture allowing entry of further air into the mixture.

A secondary air nozzle can be attached to an inlet manifold of internal combustion engine or used to entrain other fuels or both fuel and air.

When used in the environment of a pressurized injector of the form disclosed in U.S. Pat. No. 5,735,468 the efficiency of a nozzle of the present invention is not dependent on a negative pressure generated by an engine which can be the case for, say, air-assisted injectors.

BRIEF DESCRIPTION OF DRAWINGS

Preferred forms of the present invention will now be described by way of example with reference to the accompanying drawings, in which.

BEST MODE

Figure 1:
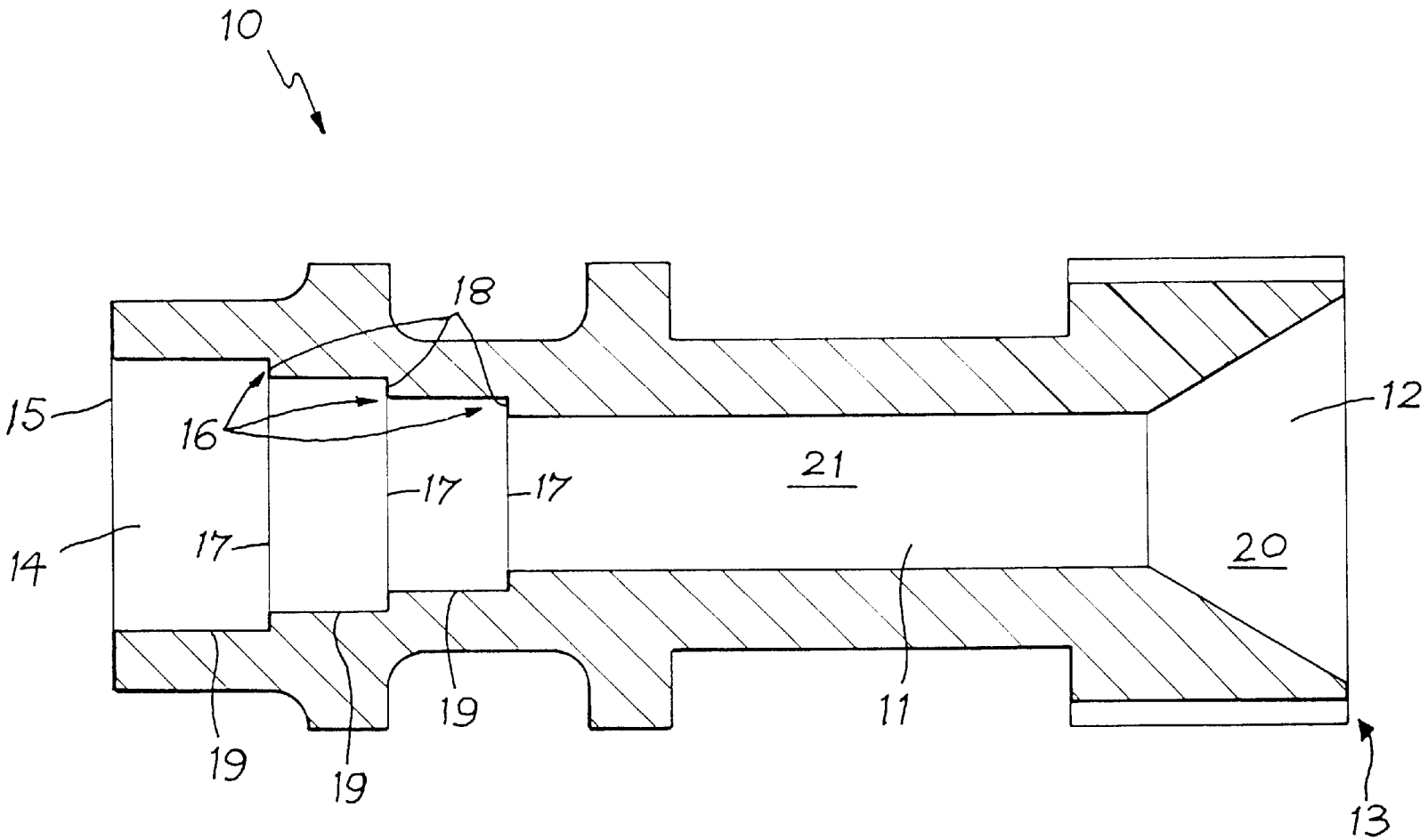
FIG. 1 is a schematic longitudinal sectional view of an embodiment of a nozzle assembly to be used in a nozzle arrangement in accord with the present invention.

The drawings show an elongate nozzle 10 with a centrally extending through passage 11, a restriction or compression zone 12 at an inlet end 13 and an expansion zone 14 proximate an outlet 15.

The expansion zone 14 is in the form of a series of three step-wise enlargements 16 each of which define circumferential discontinuities along the flow passage 11. Each step-wise enlargement 16 has a circumferential edge 17, a radially outwardly extending surface 18 which is generally normal to the central axis of the nozzle 10, and an axially extending cylindrical surface 19 having a diameter which is a predetermined amount larger than that of its associated edge 17.

The restriction zone 12 has a conical surface 20 which converges to the diameter of a throat portion 21 which is intermediate the restriction zone 12 and the expansion zone 14.

Figure 2:
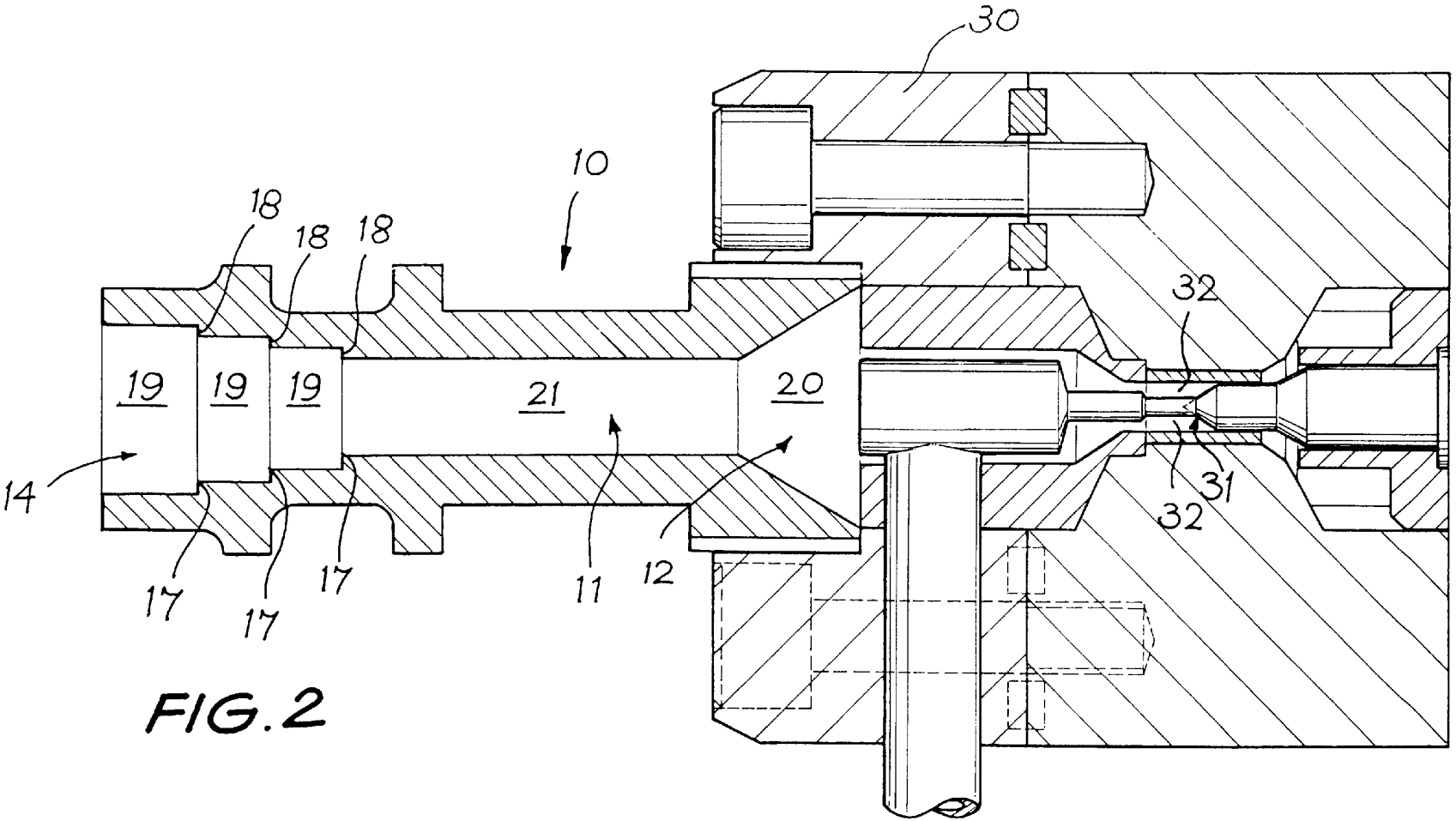
FIG. 2 is a schematic longitudinal section view of the nozzle assembly of FIG. 1 and a part of a known liquid/gas mixing apparatus.

Referring to FIG. 2, which shows the nozzle 10 mounted in a part 30 of a liquid/gas mixing apparatus which is generally as disclosed in U.S. Pat. No. 5,735,468 to the present applicant. The mixing apparatus includes a liquid valve 31 which intermittently delivers a radially or conically outwardly projecting sheet of liquid into an annular flow passage 32. The mixing apparatus 30 has gas valving (not shown) which delivers a gas stream through the passage 32 at least from a time just prior to the liquid valve 31 being opened and at least to a time just after the liquid valve 31 is closed. The stream of gas through the passage 32 acts to shear liquid particles away from the sheet of liquid producing a fine mist of liquid particles entrained in the stream of gas.

The liquid/gas mixture flows through the passage 32 of the mixing apparatus 30. The passage 32 communicates with the flow passage 11 of the nozzle 10 which is positioned downstream of the point at which the liquid particles are sheared away from the liquid sheet. The nozzle 10 defines the outlet for the mixing apparatus 30 for delivering the liquid/gas mixture which may be a fuel/air mixture into the combustion chamber of an internal combustion engine (not shown).

In use, the liquid/gas mixture enters the nozzle 10 and is compressed through the restriction zone 12 before passing into the intermediate throat portion 21. This serves to accelerate the stream of gas and liquid particles. When the stream reaches the expansion zone 14, the liquid/gas mixture expands as it passes each of the edges 17 and is thereafter delivered through the outlet 15.

When liquid droplets that have adhered to the flow passage reach the first edge 17, it is believed that the action of the gas stream passing over the discontinuity causes the accumulated liquid to be drawn off from the surface as relatively small particles, that is, having a particle size which is considerably smaller than if the accumulated liquid had been allowed to discharge from the nozzle expansion zone without such discontinuities.

More particularly, the discontinuities defined by the step-wise enlargements 16 cause the stream of gas (with entrained liquid droplets) to flow and expand radially outwardly over and around the edges 17 producing turbulence adjacent the radially projecting surface 18.

Figure 3:
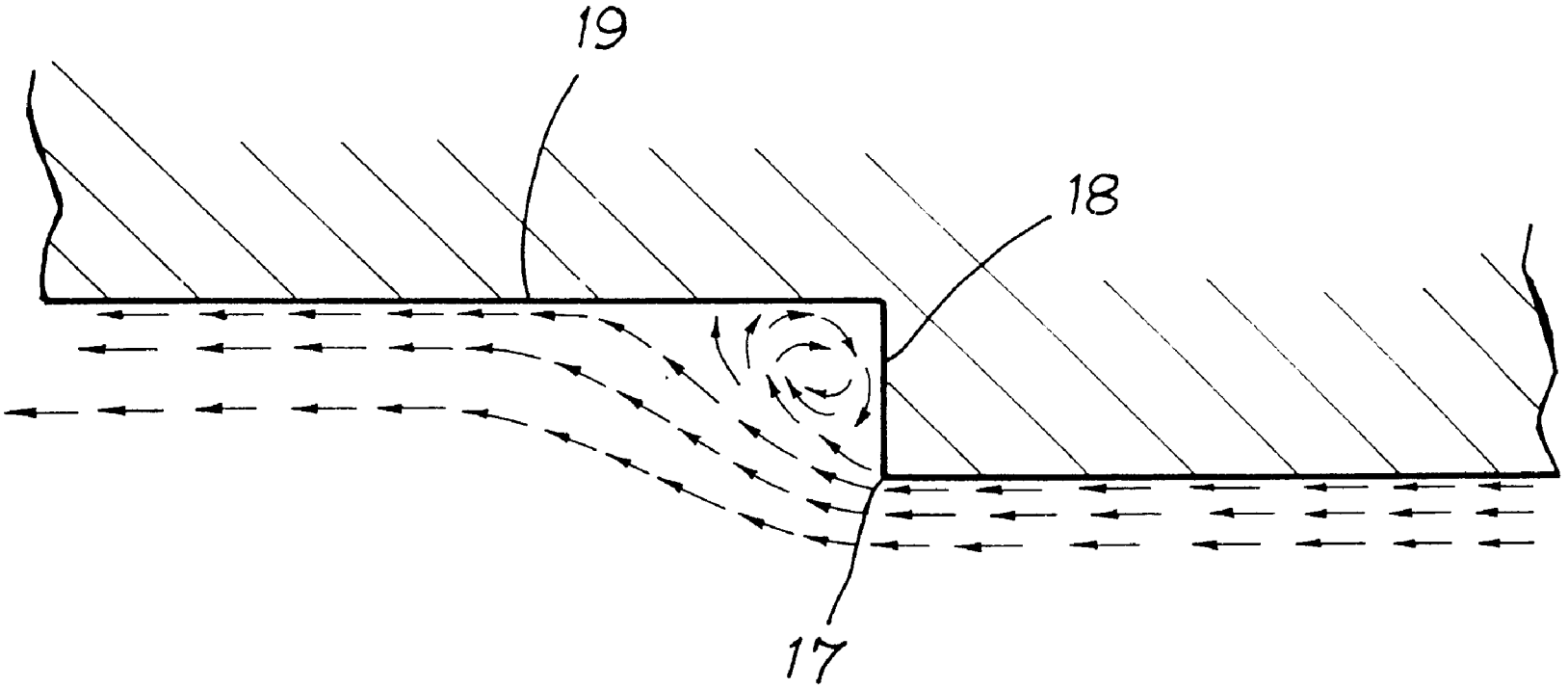
FIG. 3 is a schematic detailed view of a portion of the nozzle of FIG. 1 showing the flow of gas/liquid mixture and action of the gas stream on liquid which has adhered to the surface of the expansion zone.

It has been observed that the nozzle 10 of the embodiment of FIGS. 1–3 removes adhered liquid from the expansion zone before it is delivered through the outlet 15 as undesirably large liquid droplets which are generally not able to be burnt efficiently in a normal combustion cycle. This benefit is achieved whether the liquid valve 31 and gas valve (not shown) of the mixing apparatus 30 are opened/closed intermittently to produce intermittent bursts of liquid/gas mixture, or are kept open so as to deliver a continuous stream of the liquid/gas mixture.

Figure 4:
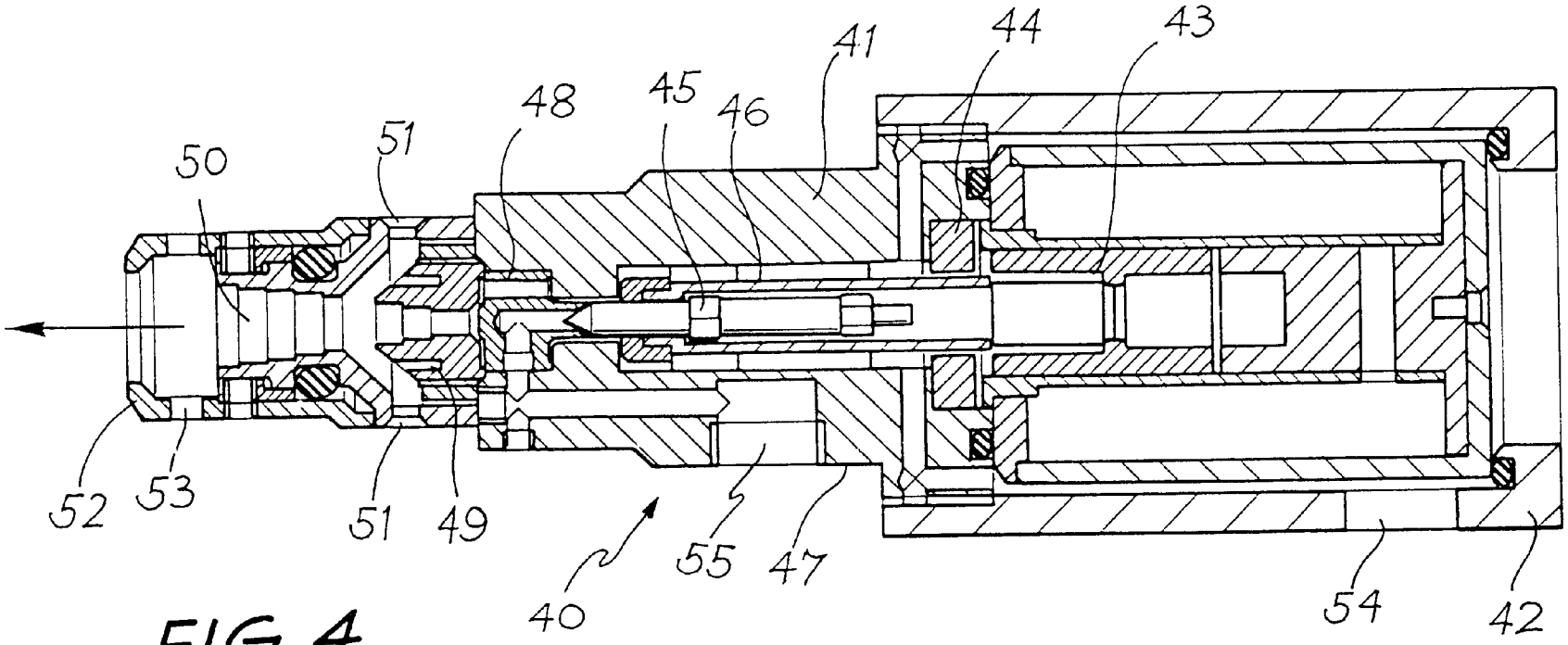
FIG. 4 is a general arrangement sectional view of an embodiment of an injector mounted to an embodiment of a two stage nozzle assembly of the present invention.

In the general arrangement view of the embodiment of FIG. 4 there is shown an injector and nozzle combination 40 comprising a solenoid actuated injector 41 fitted with a two stage nozzle arrangement comprising atomizer nozzle 49 and mixing nozzle 50.

Injector 41 comprises a solenoid cover 42 which houses a solenoid slug 43 and shuttle retainer 44.

Solenoid control needle 45 is housed within needle guide 46 which is disposed within injector body 47. Needle seat 48 is interposed between needle 45 and atomizer nozzle 49 which directs liquid/gas mixture into air mixing nozzle 50. Between atomizer nozzle 49 and air mixing nozzle 50 there are disposed a plurality of radially extending inspiration passageways 51 while about shroud 52 there are disposed a plurality of tertiary air inspiration passages 53 downstream from the outlet of air mixing nozzle 50.

In the embodiment of FIG. 4 it has been found that of the order of 1% stoichiometric air at 100 psi coupled to air inlet 54 has been sufficient to shear fuel droplets from a conical sheet of fuel, which fuel is fed via fuel inlet 55.

Figure 5:
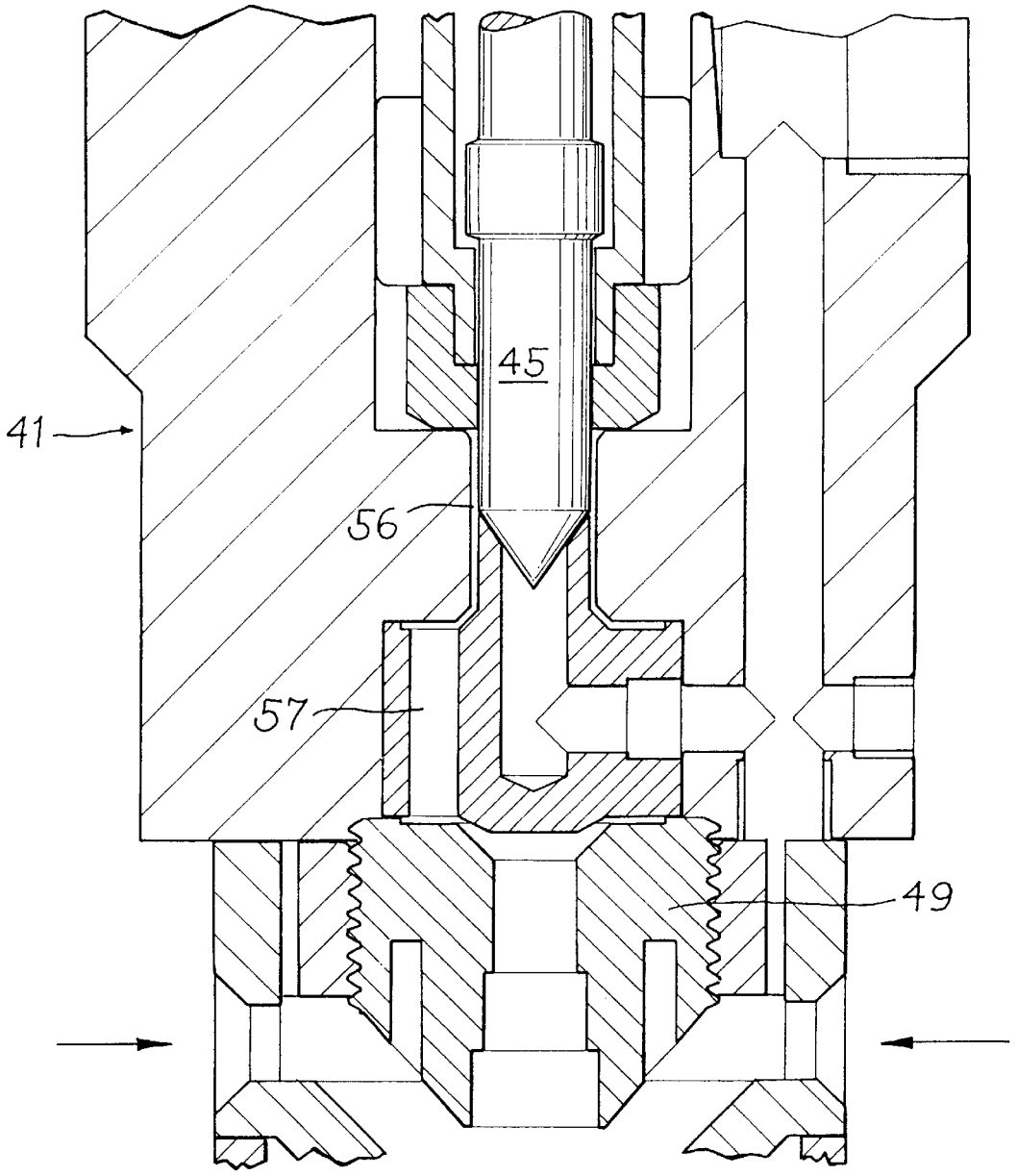
FIG. 5 is a magnified view of a portion of the injector of FIG. 4.

To better appreciate the functioning of the airflow and needle movement reference should be made to FIG. 5 which depicts circumferential gap 56 between needle 45 and the bore within injector body 41 to permit the passage of high pressure gas past a conical spray of liquid which forms upon movement of needle 45 away from seat 48. After liquid has been sheared from the conical sheet it passes along passage 56 then through a plurality of circularly disposed passageways 57 which feed into atomizer nozzle 49 then through the secondary air inspiration zone defined by passages 51 before entering air mixing nozzle 50.

Figure 6:
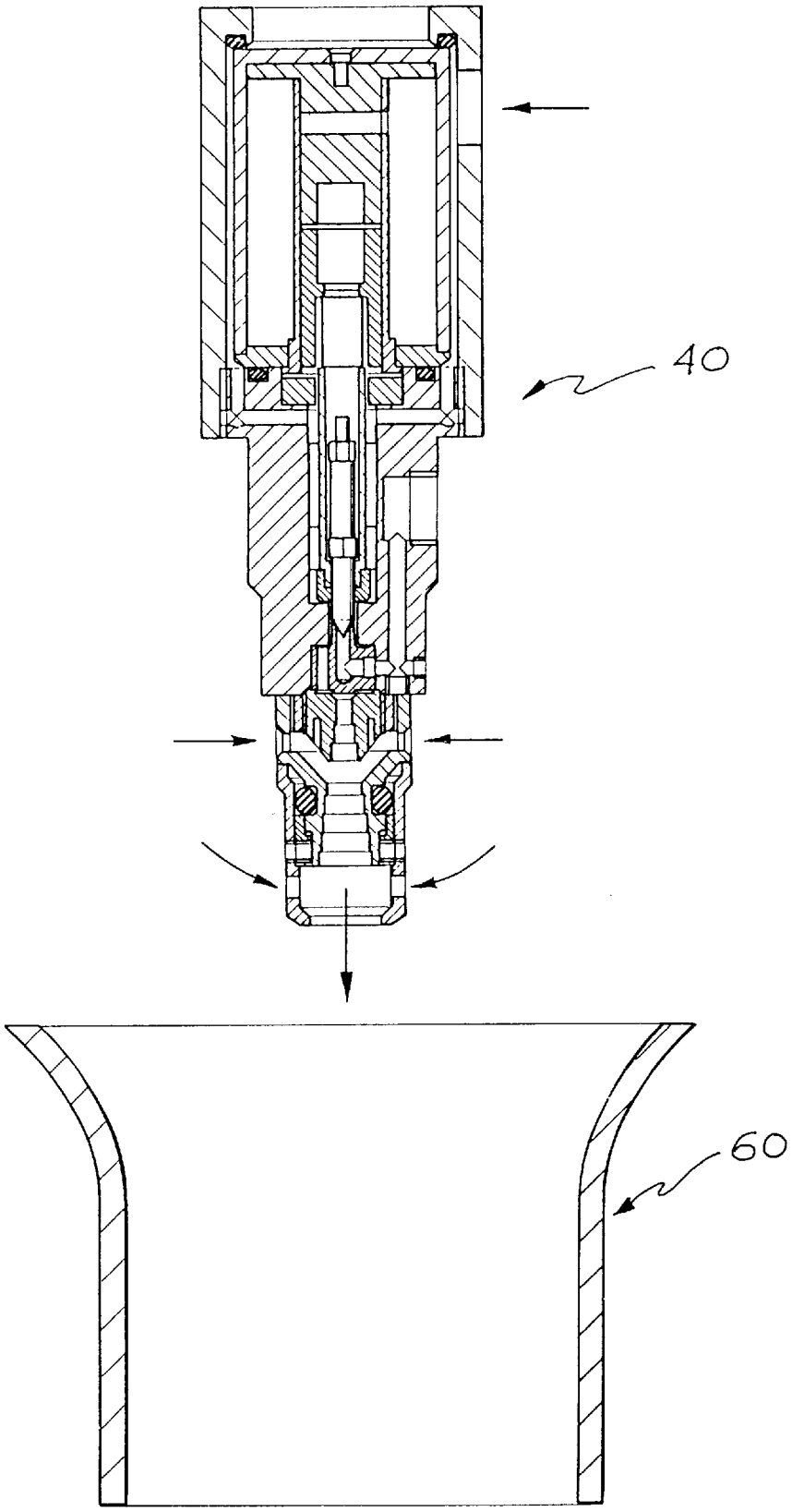
FIG. 6 schematically depicts an injector nozzle arrangement of FIG. 4 configured to provide direct injection into an inlet manifold of an internal combustion engine.

FIG. 6 shows an injector and nozzle arrangement of FIG. 4 mounted above an inlet manifold venturi 60.

Figure 7:
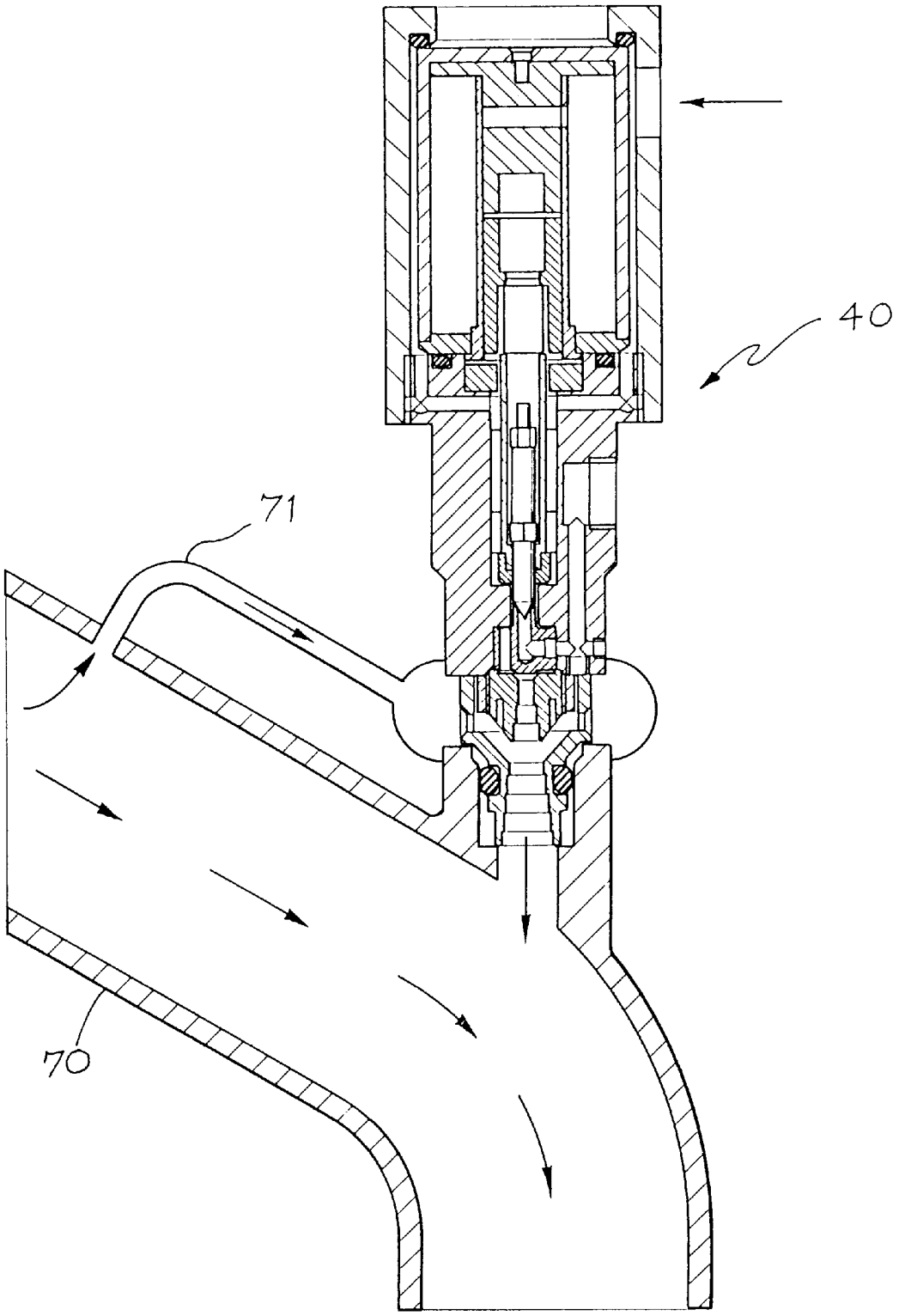
FIG. 7 is a sectional view of the injector and nozzle arrangement of FIG. 4 mounted on an intake manifold.

Another potential installation arrangement is shown in FIG. 7 where the embodiment of FIG. 4 is mounted to a naturally aspirated or supercharged air inlet manifold 70 with an air bleed passageway 71 feeding inlet manifold air to provide secondary air between nozzles 49 and 50.

Figure 8:
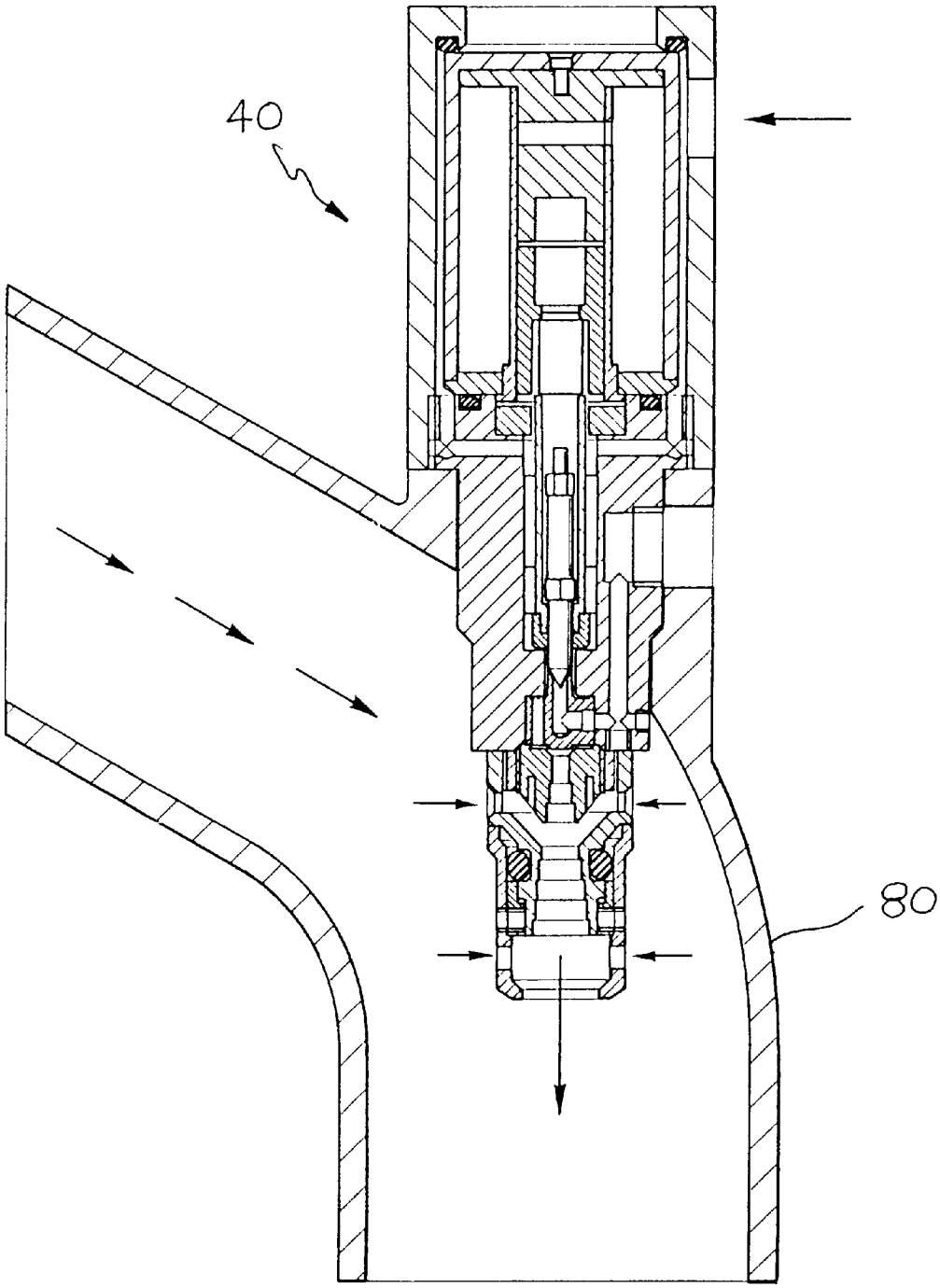
FIG. 8 is a view similar to FIG. 7 but showing the injector and nozzle arrangement mounted on an intake manifold in an alternative to that of FIG. 7.

FIG. 8 shows yet another mounting arrangement for a naturally aspirated or supercharged air inlet manifold 80 where the injector body 41 is mounted to manifold 80 with manifold air directly feeding into passages 51 rather than by a bypass arrangement as in FIG. 7.

While the nozzles of the depicted embodiments have been described in conjunction with mixing apparatus, it will be appreciated that each nozzle may be used in single or multi-stage form in any application where a liquid/gas mixture is to be delivered subject to any relevant design criteria.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A nozzle arrangement for delivering a liquid/gas mixture comprising a plurality of nozzle assemblies, each nozzle assembly comprising;

a body having a flow through passage leading to an outlet;

an expansion zone proximate the outlet, and at least one discontinuity in the expansion zone formed as a radially extending step-wise enlargement followed by a parallel-sided cylindrical portion extending toward the outlet, said discontinuity being adapted to reduce liquid film adherence at the outlet, and wherein the nozzle assemblies are axially aligned and spaced apart by respective gas and/or liquid inspiration zones.

2. A nozzle arrangement as claimed in claim 1 wherein the at least one discontinuity is of substantially circumferential extent.

3. A nozzle arrangement as claimed in claim 1 wherein there are a plurality of discontinuities in the expansion zone of each nozzle assembly.

4. A nozzle arrangement as claimed in claim 1 wherein the flow through passage has a restriction zone upstream of the expansion zone.

5. A nozzle arrangement as claimed in claim 4 wherein the restriction zone is a smoothly contracting portion of the flow passage which leads to a throat portion between the restriction and expansion zones.

6. A nozzle arrangement as claimed in claim 1 wherein the flow through passage is of a generally circular cross-sectional shape.

7. A nozzle arrangement as claimed in claim 1 wherein the outlet of a final downstream nozzle assembly is surrounded by a downstream extending shroud, and wherein said shroud comprises an inspiration zone for a gas and/or a liquid to be added to the liquid/gas mixture downstream of said outlet.

8. A nozzle arrangement for delivering a liquid/gas mixture comprising an injector for forming a pressurized liquid/gas atomized mixture and delivering the same to an outlet thereof, a plurality of nozzle assemblies, with each nozzle assembly comprising a body having a flow passage extending axially therethrough from an inlet end to an outlet end, an expansion zone formed in the flow passage proximate the outlet end thereof, and at least one discontinuity in the expansion zone formed as a radially extending step-wise annular shoulder followed by a cylindrical portion; and said nozzle assemblies being disposed in an axially spaced apart arrangement defining gas and/or liquid inspiration zones between each assembly and being aligned adjacent the outlet of the injector, such that the atomized mixture flows serially through the flow passages of the nozzle assemblies, with the discontinuities of the nozzle assemblies acting to reduce liquid film adherence in the flow passages of the nozzle assemblies.

9. A nozzle arrangement as claimed in claim 8 further comprising a gas or liquid inspiration zone interposed between adjacent nozzle assemblies.

10. A nozzle arrangement as claimed in claim 9 further comprising a downstream extending shroud mounted to the final downstream nozzle assembly, and wherein the shroud comprises an inspiration zone for a gas and/or a liquid to be added to the atomized mixture flowing through the nozzle assemblies.

11. A method of delivering a liquid/gas mixture comprising the steps of;

adding the liquid to a flow of the gas so that the liquid is substantially atomized;

feeding the so formed liquid/gas mixture through a flow restriction to a first expansion zone;

expanding the mixture in the expansion zone through at least one expanding discontinuity in the first zone to an outlet thereof;

adding inspirated liquid and/or gas to the liquid/gas mixture downstream of the outlet of the first expansion zone and then passing the resulting mixture through at least one further expansion zone having at least one further expanding discontinuity therein and then delivering the resulting/mixture to an outlet of the at least one further expansion zone.

12. A method as claimed in claim 11 comprising the further step of adding inspirated gas and/or liquid to the resulting mixture downstream of the outlet of the at least one further expansion zone.

* * * * *

UNITED STATES PATENT AND TRADEMARK OFFICE

CERTIFICATE OF CORRECTION

PATENT NO. : 6,010,077

DATED : January 4, 2000

INVENTOR(S) : Casey

It is certified that error appears in the above-indentified patent and that said Letters Patent is hereby corrected as shown below:

Title page, insert the following:

--Foreign Application Priority Data

June 9, 1995 Australia PN3473--.

Title page, [56] References Cited, U.S. PATENT DOCUMENTS, insert the following:

--2,599,422 6/1952 Yettaw 5,125,582 6/1992 Surjaatmadja et al.

5,449,114 9/1995 Wells et al.

5,735,468 4/1998 Casey--.

Signed and Sealed this

Sixth Day of March, 2001

Nicholas P. Godici

*Attest:*

NICHOLAS P. GODICI

*Attesting Officer*

*Acting Director of the United States Patent and Trademark Office*